US006231405B1

(12) United States Patent
Diconne et al.

(10) Patent No.: US 6,231,405 B1
(45) Date of Patent: May 15, 2001

(54) CONNECTION ACCESSORY AND TERMINAL EQUIPPED WITH SUCH AN ACCESSORY

(75) Inventors: Robert Diconne, Sassenage; Bernard Lepretre, Saint Martin le Vinoux; Didier Philippe, Grenoble, all of (FR)

(73) Assignee: Schneider Electric SA (FR)

( * ) Notice: Subject to any disclaimer, the term of this patent is extended or adjusted under 35 U.S.C. 154(b) by 0 days.

(21) Appl. No.: 09/273,710

(22) Filed: Mar. 22, 1999

(30) Foreign Application Priority Data

Apr. 17, 1998 (FR) ..... 98 05122

(51) Int. Cl.[7] ..... H01R 9/22; H01R 4/36
(52) U.S. Cl. ..... 439/812; 439/709
(58) Field of Search ..... 439/709, 791, 439/810, 811, 812, 813, 814

(56) References Cited

U.S. PATENT DOCUMENTS 3,124,409 * 3/1964 Nisula ..... 439/791
3,611,249 * 10/1971 Lovrenich ..... 439/78
5,203,716 * 4/1993 Martucci et al. ..... 439/411
5,226,634 * 7/1993 Rudy, Jr. et al. ..... 267/181
5,296,646 * 3/1994 Capper et al. ..... 174/51

FOREIGN PATENT DOCUMENTS 59561 12/1972 (AU) .
310050 12/1955 (CH) .
40 26 037 A1 2/1992 (DE) .

* cited by examiner

*Primary Examiner*—Lincoln Donovan
*Assistant Examiner*—Chandrika Prasad
(74) *Attorney, Agent, or Firm*—Parkhurst & Wendel, L.L.P

(57) ABSTRACT

The present invention relates to a connection accessory and to a terminal equipped with such an accessory.

This accessory is designed to perform connection of an electrical conductor such as an aluminum cable to a contact strip of an electrical apparatus such as a circuit breaker. This accessory is characterized in that it comprises a pad made of a conducting material and presenting an appreciably U-shaped transverse cross section, said pad being able to be fixed in removable manner onto the contact strip and to receive a conductor designed to be clamped against the pad by a clamping means in order to establish the electrical contact between the contact strip and the cable.

11 Claims, 4 Drawing Sheets

CONNECTION ACCESSORY AND TERMINAL EQUIPPED WITH SUCH AN ACCESSORY

BACKGROUND OF THE INVENTION

The present invention relates to a connection accessory for connection of an electrical conductor such as an aluminum cable to a contact strip of an electrical apparatus such as a circuit breaker, and also to a terminal equipped with such an accessory.

Conventional connection terminals are designed to perform connection of copper cables to the contact strips of apparatuses such as circuit breakers, but are not suitable for connection of aluminum cables. This results in the user, when he wants to use aluminum cables, having to replace the kit formed by the tunnel and screw by another kit designed for connection of aluminum cables.

One of the reasons for this is that aluminum has a strong tendency to oxidize in the open air, which results in aluminum cables over the course of their use becoming covered with insulating alumina reducing the quality of the contact between the cable and contact strip.

The other reason is that aluminum presents a high expansion coefficient due to the effect of temperature variations. Circuit breakers, since they are supplied by variable currents, do however go through alternate heating and cooling phases. This results in temperature variations giving rise to variations in the dimensions of the cables by differential expansion. The cables are, however, in general in contact on the one hand with the contact strip most frequently made of copper, and on the other hand either with the steel screw or with the tunnel also made of steel. But these three materials present different expansion coefficients, which results in them not retracting in the same manner during the cooling phases. This leads to a connection loosening phenomenon which on the one hand, in itself, reduces the quality of the electrical contact, and on the other hand fosters formation of a layer of alumina also liable to reduce the quality of the electrical contact.

Several solutions have been imagined to overcome these shortcomings.

One of the solutions is described in the German Patent DE 4,026,037. In this document, the cable is brought into contact with the contact strip by a steel tunnel moved in translation by the terminal screw. In order to overcome the problem of oxidation of the aluminum, the copper contact strip and the aluminum tunnel respectively present two serrations facing one another forming elongate claws designed to pass through the layer of alumina covering the cable, so as to improve the contact between the contact strip and tunnel.

In this document, one of the above-mentioned problems has therefore been solved by achieving a specific system for connection of aluminum cables, which due to the presence of these claws presents a high cost price.

Another solution is known wherein the terminal is formed by an aluminum block comprising on the one hand an elongate passage for passage of the contact strip and on the other hand a threaded orifice designed for passage of the terminal screw also made of aluminum. In this embodiment, the bottom wall of the tunnel presents a U-shaped cross section so as to match the shape of the cable, and the screw presents a convex end so that the cable is held captive between the bottom of the tunnel and the screw. In this embodiment, all the component parts being made of aluminum, no differential expansion occurs. The absence of differential expansion of the different elements and the fact that the cable is closely surrounded enable the problem of expansion of the aluminum cables and of formation of alumina on the cable to be satisfactorily solved. However, this solution still presents certain drawbacks resulting on the one hand from the fact that this tunnel has to present a large thickness whence a large quantity of alloy being necessary, and on the other hand from the fact that the tunnel being liable to oxidize itself needs to be tinned. This results in a terminal which is delicate to manufacture, costly and bulky.

SUMMARY OF THE INVENTION

The present invention solves these problems and proposes a connection accessory enabling standard terminals to be used to perform connection of aluminum cables in simple and reliable manner.

For this purpose, an object of the present invention is to achieve a connection accessory of the kind mentioned above, this accessory being characterized in that it comprises a pad made of a conducting material, said pad being designed to be fixed in removable manner onto the contact strip and to receive a conductor designed to be clamped against the pad by a clamping means in order to establish the electrical contact between the contact strip and the cable.

Thus, when aluminum cables are to be connected, it is no longer necessary to replace the whole of the terminal, and a standard terminal can be used.

According to a particular embodiment, the above-mentioned pad presents an appreciably U-shaped transverse cross section.

This particular pad shape enables a good electrical contact quality to be obtained.

According to a particular feature, the above-mentioned pad comprises, on its face facing the conductor, serrations extending perpendicularly to the longitudinal direction of the conductor.

According to a particular feature, the pad is secured to the contact strip by means of a support, said support comprising a flexible blade fixed to the pad via one of its ends and comprising a curved part underneath the pad extending in a direction appreciably parallel to said pad, so as to enable flexible clamping of the contact strip between the pad and the curved part.

According to another feature, the connector accessory being designed to be fitted in the tunnel of an electrical terminal, it comprises in addition at least one lug extending from the plane of the curved part in an inclined direction with respect to said plane and in a direction away from the pad, said at least one lug pressing against a wall of the tunnel so as to absorb the expansion differences between the different elements taking part in clamping.

Advantageously the at least one lug is molded in the same material as the blade.

Preferably the support comprises three lugs arranged in a triangle.

Advantageously the curved part comprises a boss, on its face facing the pad, designed to enable the pad to be fitted onto contact strips of different thicknesses.

An object of the invention is also to achieve a terminal equipped with an accessory comprising the previously mentioned features taken alone or in combination.

The terminal can be of the fixed tunnel or of the movable tunnel type.

Advantageously the tunnel comprises a recess in its bottom wall designed to receive the lug(s) of an accessory.

BRIEF DESCRIPTION OF THE DRAWINGS

But other advantages and features of the invention will become more clearly apparent from the following description which refers to the accompanying drawings given as a non-restrictive example only and in which.

DETAILED DESCRIPTION OF THE PREFERRED EMBODIMENT

Figure 1:
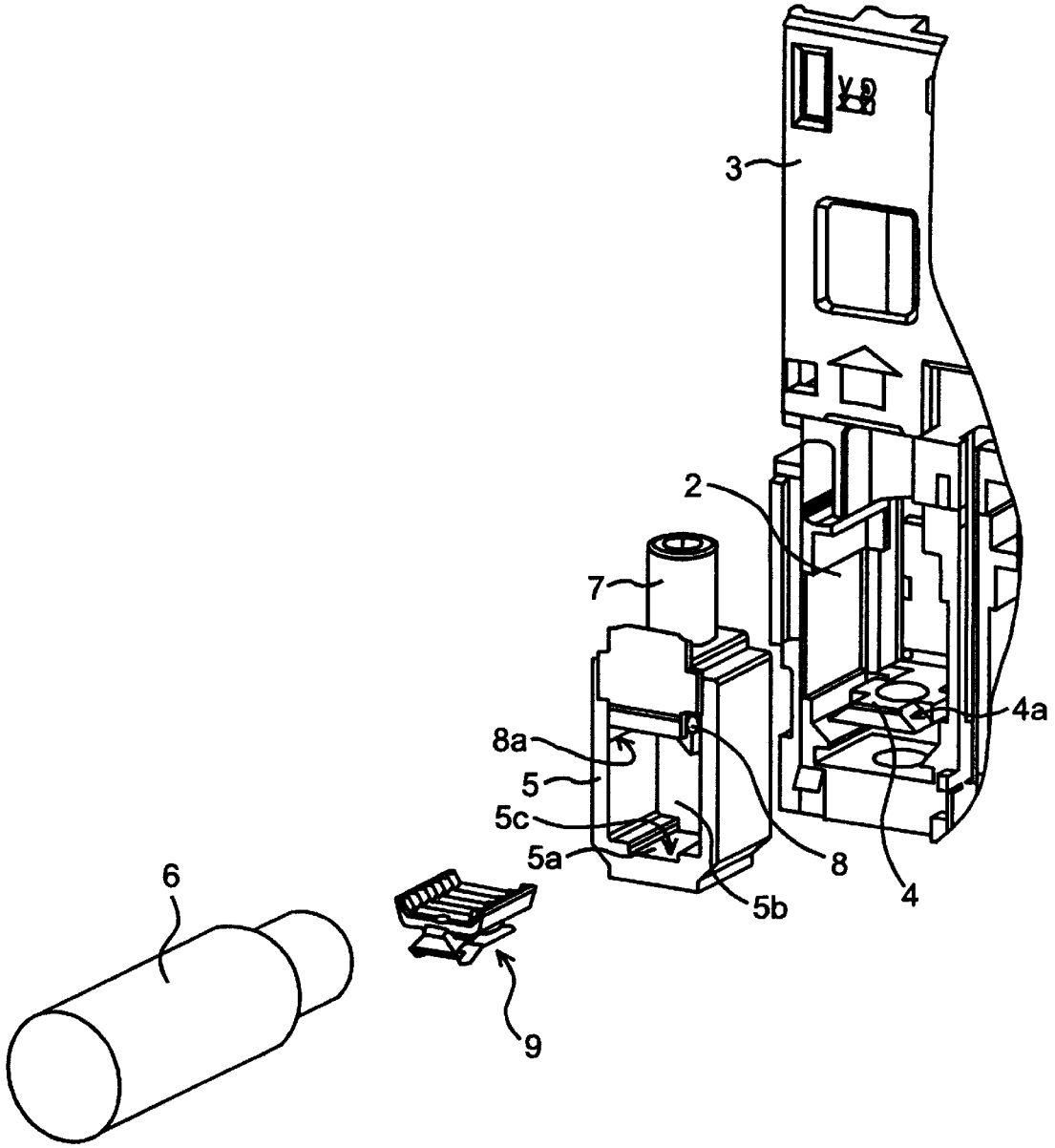
FIG. 1 is a partial perspective view illustrating the rear part of a circuit breaker comprising a terminal equipped with a connection accessory according to the invention, the terminal and accessory having been removed from the apparatus.
Figure 2:
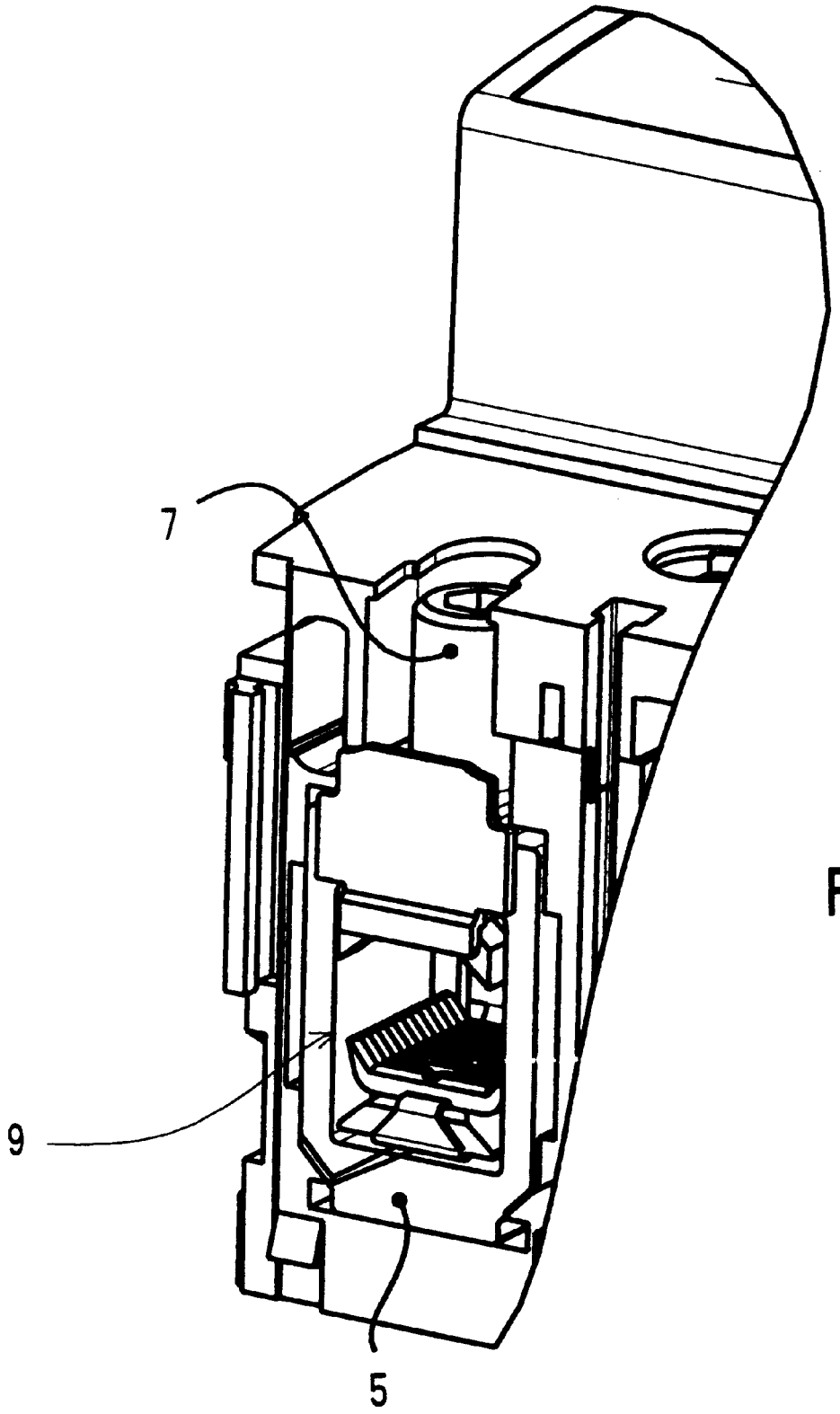
FIG. 2 is a similar view to FIG. 1, the terminal and accessory being fitted in the rear part of the apparatus.

In FIGS. 1 and 2, a terminal 5 can be seen designed to be fitted in a housing 2 provided in the rear part of a circuit breaker 3 to perform connector of an electrical cable 6 to the contact strip 4 of the circuit breaker. This terminal is mainly formed by a metal block 5 of appreciably parallelepipedic shape comprising an elongate passage 5*b* designed to receive the above-mentioned contact strip 4, and comprises at its upper part a tapped orifice into which a screw 7 called the terminal screw is screwed, designed to perform clamping of the cable 6 onto the contact strip 4. This screw 7 is accessible from the upper part of the apparatus and comprises at its end situated inside the terminal 5, a pad 8 comprising claws 8*a* designed to operate in conjunction with complementary recesses 4*a* provided in the contact strip 4.

According to the invention, this terminal 5 is equipped with a connection accessory 9 designed to be used for performing connection of an aluminum cable to the contact strip.

Figure 3:
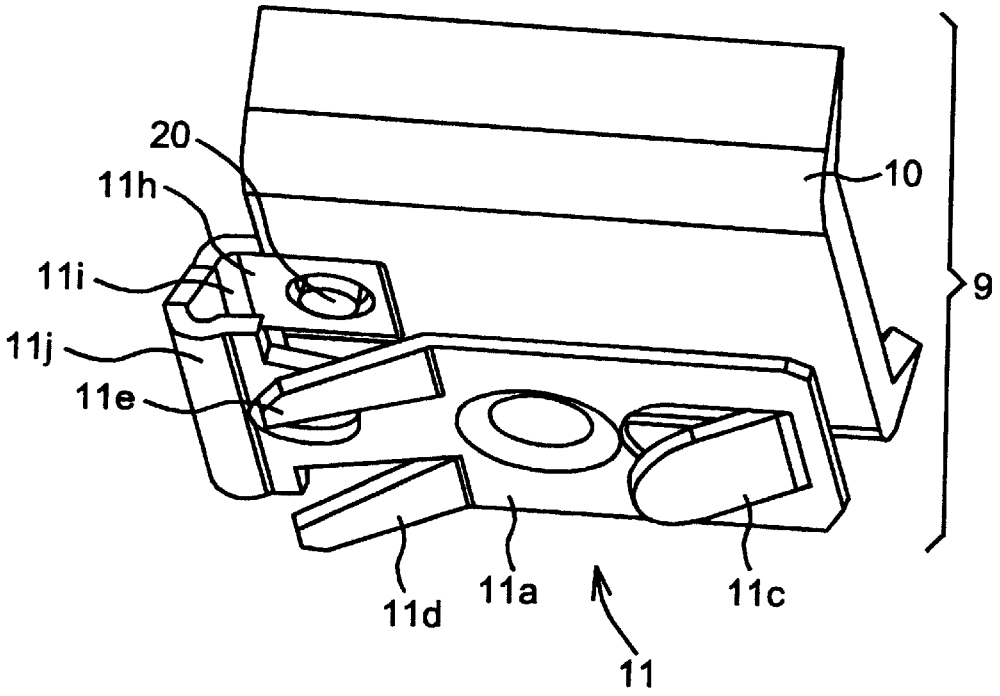
FIGS. 3 and 4 are perspective views of the accessory.
Figure 4:
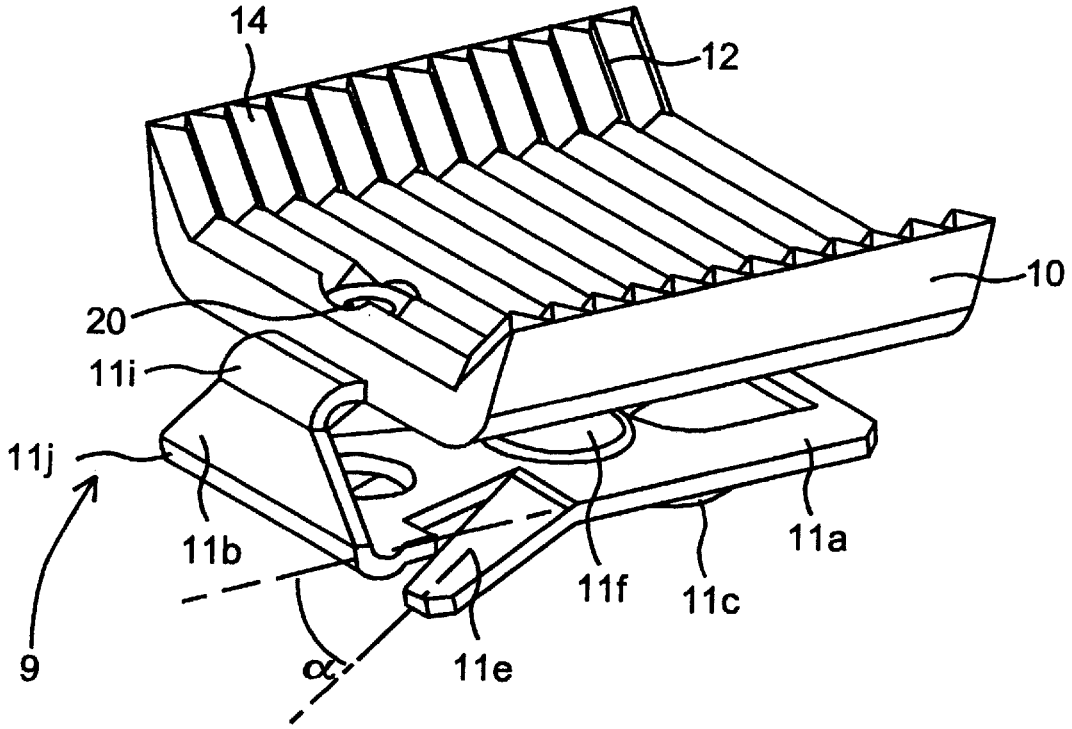

As is more particularly illustrated in FIGS. 3 and 4, this accessory 9 comprises a pad 10 mounted on a support 11, the assembly being designed to be fixed flexibly to the circuit breaker contact strip 4. This pad 10 presents an appreciably U-shaped cross section and comprises, on its face 14 designed to receive the conductor 6, a set of serrations 12 extending perpendicularly to the direction of the cable 6 when it is inserted in the terminal.

The support 11 is formed by a flexible blade fixed via one 11 b of its ends to one of the ends of the pad 10 and folded twice appreciably at right angles so as to form a curved part 11 a extending underneath the pad 10 in a direction appreciably parallel to the pad 10.

It can also be seen in these figures that the curved part 11 a of the blade comprises three tabs or lugs 11*c*, 11*d*, 11*e* molded in the same material as the flexible blade and extending according to an inclined direction with respect to the plane of the curved part forming an angle $\alpha$ of about 30° with this plane. These tabs are designed to press via their end on the bottom wall 5*c* of a recess 5*a* provided in the terminal 5 to house these lugs.

It can also be noted that the flat distal portion of the flexible blade 11*a* comprises a boss 11*f*, on its surface facing the accessory pad 10, designed to enable the connector assembly 9 to be fitted either onto a 2.5 mm contact strip or onto a 1.6 mm contact strip. The boss 11*f* may be molded of the same material as the flexible blade 11, and created by stamping or imprinting the blade's distal-end 11*a*.

Advantageously, the screw 7 and its pad 8 are made of steel, whereas the block 5 is made of aluminum. The blade of the support 11 is made of stainless spring steel and riveted to the pad 10 of the accessory, which pad is advantageously made of tinned copper.

Figure 5:
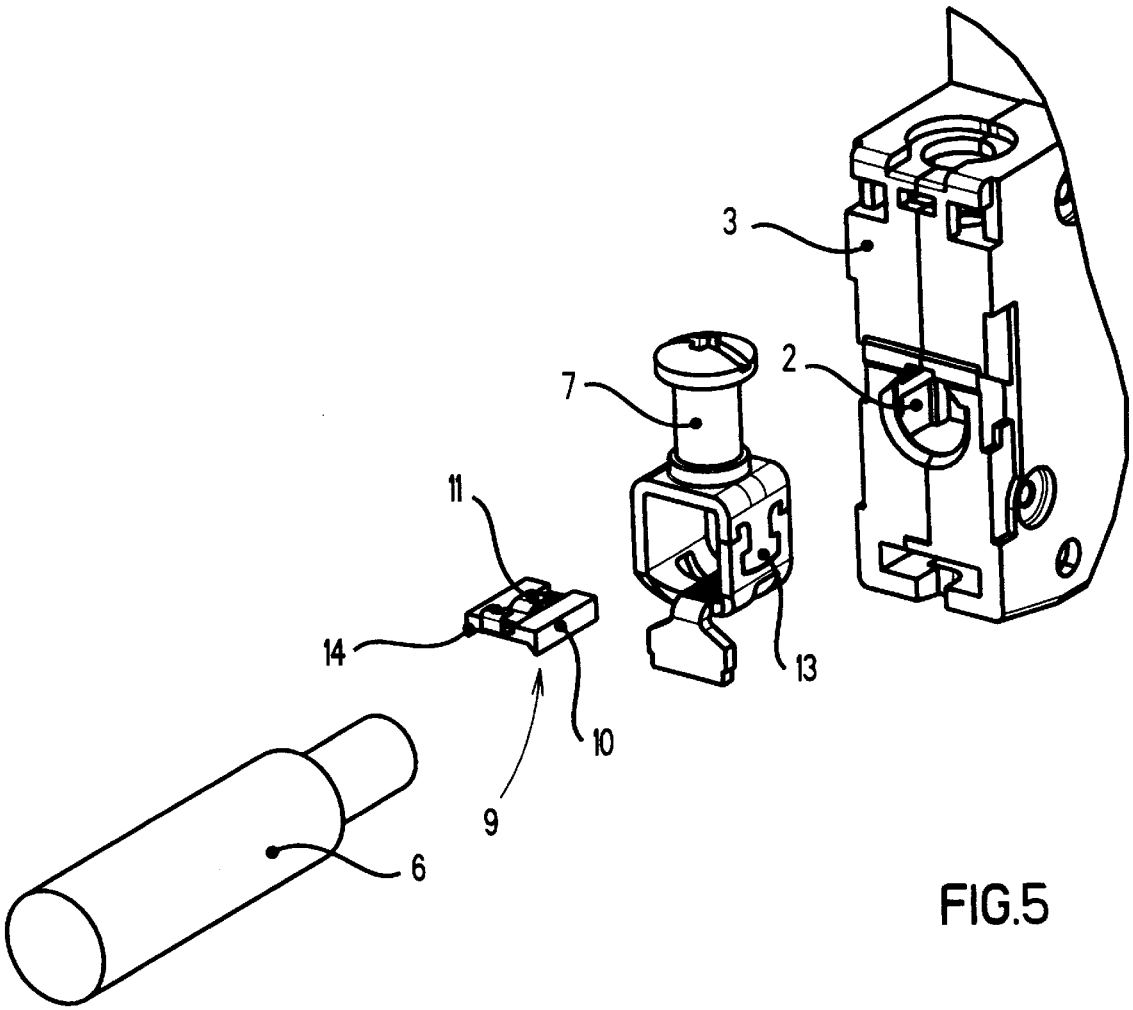
FIG. 5 is a similar perspective view to FIG. 1, but illustrating a terminal according to another embodiment of the invention.

According to the embodiment illustrated in FIG. 5, the circuit breaker terminal comprises a tunnel 13 mounted movable in translation in the terminal housing 2 of the apparatus between a disconnection position and a position wherein the tunnel 13 performs clamping of the cable 6 onto the contact strip (not represented).

The connection operation of an aluminum cable onto the contact strip will be described hereafter with reference first of all to FIGS. 1 and 2 and then to FIG. 5.

According to the embodiment illustrated in FIGS. 1 and 2, the block 5 is first of all inserted into the rear part 3 of the apparatus by sliding of said block 5 into the corresponding housing 2. Then the connector accessory 9 is fitted onto the contact strip 4 in such a way that the contact strip 4 is held flexibly between the pad 10 and the curved part 11*a* of the flexible blade. The conductor 6 is then inserted in the passage 5*b* of the block and placed on the pad 10. Then tightening of the terminal screw 7 has the effect of applying the pad 8 with claws 8*a* onto the cable 6 and of performing clamping of the conductor 6 onto the contact strip 4. In this clamping position, the U-shape of the pad 10 enables the cable strands to be contained between the clawed pad 8 of the screw 7 and the pad 10 of the accessory 9 in order to prevent buckling thereof.

Furthermore, the flexible lugs or tabs 11*c*, 11*d*, 11*e* serve the purpose of maintaining a constant pressure on the screw thread to prevent the tunnel screw from coming loose due to the effect of the expansion differences of the aluminum cable and of the steel tunnel screw. They moreover reduce the risks of the screw coming loose due to the effect of vibrations.

The connection operation by means of a device according to FIG. 5 is carried out in he same way as previously described for the first embodiment, the only difference being that it is the tunnel 13 which moves in translation and not the screw, and which performs clamping of the cable, said cable being fitted between the pad 10 of the accessory and the tunnel 13.

This accessory enables standard terminals to be used (at present designed for copper cables) for connection of the aluminum cables while preserving a satisfactory electrical contact quality.

What is claimed is:

1. An accessory for connection of an electrical conductor or cable to a contact strip of an electrical apparatus comprising:

an accessory pad secured to a contact strip by a flexible blade, wherein the accessory pad comprises a conducting material, the accessory pad being removably fixable onto the contact strip for receiving a conductor to be clamped against the accessory pad by a clamping means to establish electrical contact between the contact strip and a cable;

the flexible blade comprises a proximal-end, a mid-section, and a distal-end, the proximal-end attached to the accessory pad, the blade having first and second folds, wherein the first fold and the second fold define a mid-section, the first fold is located proximal to the second fold and the mid-section extends perpendicularly from the accessory pad, the flexible blade curving 180 degrees, enabling flexible clamping of the contact strip between the accessory pad and the distal-end of the flexible blade, and further comprising at least one lug extending from the plane of the distal-end portion of the flexible blade in an inclined direction with respect to the plane and in a direction away from the pad for easing insertion of the flexible blade into a tunnel of an electrical terminal when the distal-end of the flexible blade enters first, said at least one lug for pressing against a wall of a tunnel of an electrical terminal.

2. The accessory according to claim 1, wherein the pad and support comprise a substantially U-shaped transverse cross section.

3. The accessory according to claim 1, wherein the accessory pad comprises, on its face facing the conductor, serrations extending perpendicularly to the longitudinal direction of the conductor.

4. The accessory according to claim 1, wherein the at least one lug is formed into the material of the blade.

5. The accessory according to claim 1, wherein the support comprises three lugs arranged in a triangle.

6. The accessory according to claim 1, wherein the distal end comprises a boss, on its face facing the pad, designed to enable the pad to be fitted onto contact strips of different thicknesses.

7. A terminal comprising a tunnel equipped with an accessory according to claim 1.

8. The terminal according to claim 7, comprising a fixed tunnel, said tunnel comprising an orifice for insertion of a clamping screw for securing a conductor.

9. The terminal according to claim 8, comprising a tunnel movable between a position clamping a conductor onto the contact strip and a disconnection position.

10. A terminal comprising a tunnel, wherein the tunnel comprises a recess in its bottom wall designed to receive the lug(s) of an accessory according to claim 1.

11. The accessory according to claim 6, wherein the boss is a formed portion of the blade.

* * * * *

UNITED STATES PATENT AND TRADEMARK OFFICE

CERTIFICATE OF CORRECTION

PATENT NO. : 6,231,405 B1
DATED : May 15, 2001
INVENTOR(S) : Robert Diconne et al.

It is certified that error appears in the above-identified patent and that said Letters Patent is hereby corrected as shown below:

Columns 1-6 should be deleted, and substitute therefor columns 1-6, as shown on the attached pages.

Signed and Sealed this

Twenty-seventh Day of August, 2002

*Attest:*

*Attesting Officer*

JAMES E. ROGAN
*Director of the United States Patent and Trademark Office*

CONNECTION ACCESSORY AND TERMINAL EQUIPPED WITH SUCH AN ACCESSORY

BACKGROUND OF THE INVENTION

The present invention relates to a connection accessory for connecting an electrical conductor, such as an aluminum cable, to a contact strip of an electrical apparatus, such as a circuit breaker; and also to a terminal equipped with such an accessory.

Conventional connection terminals are designed to connect copper cables to the contact strips of apparatuses, such as circuit breakers, but are not suitable for connecting aluminum cables. Therefore, when a user wishes to connect aluminum cables, he must replace the kit formed by the tunnel and screw with another kit for connecting aluminum cables.

In part, this problem is caused by aluminum's strong tendency to oxidize in the open air. As a result aluminum cables, over the course of their use, become covered with insulating alumina thereby, reducing the quality of the contact between the cable and contact strip.

The other reason is that aluminum presents a high expansion coefficient in response to temperature variations. Circuit breakers, because they are supplied by variable currents, go through alternate heating and cooling phases. The temperature variations create variations in the dimensions of the cables by differential expansion. Generally, the cables are in contact with a contact strip most frequently made of copper, and either with a steel screw or with a steel fabricated tunnel. But these three materials present different expansion coefficients, which results in them not retracting in the same manner during the cooling phases. This leads to a connection loosening phenomenon which reduces the quality of the electrical contact, and fosters formation of a layer of alumina. The alumina layer may further reduce the quality of the electrical contact.

Several solutions have been imagined to overcome these shortcomings.

German Patent DE 4,026,037 describes one solution. In this document, the cable is brought into contact with the contact strip by a steel tunnel moved in translation by the terminal screw. To overcome the problem of aluminum's oxidation, the copper contact strip and the aluminum tunnel respectively present two serrations facing one another forming elongate claws designed to pass through the layer of alumina covering the cable, so as to improve the contact between the contact strip and tunnel.

In this document, one of the above-mentioned problems has been solved by achieving a specific system for connecting aluminum cables. Unfortunately, these claws are an expensive component.

Another known solution requires the terminal to be formed by an aluminum block comprising an elongate passage, for passage of the contact strip, and a threaded orifice, designed for passage of the terminal screw, also made of aluminum. There, the bottom wall of the tunnel presents a U-shaped cross section so as to match the shape of the cable, and the screw presents a convex end so that the cable is held captive between the bottom of the tunnel and the screw. In this embodiment, all the component parts are made of aluminum, therefore no differential expansion occurs. The absence of differential expansion of the different elements, and the fact that the cable is closely surrounded, satisfactorily solve the problem of expansion of the aluminum cables and of formation of alumina on the cable. However, this solution still presents certain drawbacks. The tunnel has to present a large thickness, thereby consuming a large quantity of alloy, and that the tunnel, being susceptible to oxidation, needs to be tinned. The resulting terminal is delicate to manufacture, costly, and bulky.

SUMMARY OF THE INVENTION

The present invention solves these problems, and proposes a connection accessory enabling standard terminals to be used to perform connection of aluminum cables in a simple and reliable manner.

For this purpose, an object of the present invention is to achieve a connection accessory of the kind mentioned above. The accessory comprises a pad made of a conducting material. The accessory pad being designed to be fixed in a removable manner onto the contact strip, and to receive a conductor. The conductor is clamped against the accessory pad by a clamping means in order to establish electrical contact between the contact strip and the cable.

Thus, when connecting aluminum cables, it is no longer necessary to replace the terminal, and a standard terminal can be used.

According to a particular embodiment, the above-mentioned pad presents an appreciably U-shaped transverse cross section.

This particular pad shape ensures a good electrical contact.

According to a particular feature, the above-mentioned pad comprises, on its conductor facing surface, serrations extending perpendicularly to the longitudinal direction of the conductor.

According to a particular feature, the pad is secured to the contact strip by means of a support, the support comprising a flexible blade fixed to the pad via one of its ends and comprising a curved part underneath the pad extending in a direction appreciably parallel to said pad, so as to enable flexible clamping of the contact strip between the pad and the blade's unattached end.

According to another feature, the connector accessory being designed to be fitted in the tunnel of an electrical terminal, it additionally comprises one or more lugs extending from the plane of the curved part in an inclined direction with respect to said plane and in a direction away from the pad, the lug or lugs pressing against a wall of the tunnel so as to absorb the expansion differences between the different elements taking part in clamping.

Advantageously the lug or lugs are is molded of the same material as the blade.

Preferably the support comprises three lugs arranged in a triangle.

Advantageously the blade's unattached distal-end features a boss, on its pad facing surface. This allows the pad to be fitted onto contact strips of different thicknesses.

An object of the invention is also to achieve a terminal equipped with an accessory comprising the previously mentioned features taken alone or in combination.

The terminal can be of either the fixed tunnel, or the movable tunnel type.

Advantageously the tunnel comprises a recess in its bottom wall designed to receive the lug(s) of an accessory.

BRIEF DESCRIPTION OF THE DRAWINGS

Other advantages and features of the invention will become more apparent from the following description, which refers to the accompanying drawings given as a non-restrictive example only, and in which:

FIG. 1 is a partial perspective view illustrating the rear part of a circuit breaker comprising a terminal equipped with a connection accessory according to the invention, the terminal and accessory having been removed from the apparatus;

FIG. 2 is a similar view to FIG. 1, the terminal and accessory being fitted in the rear part of the apparatus;

FIGS. 3 and 4 are perspective views of the accessory; and

FIG. 5 is a similar perspective view to FIG. 1, but illustrating a terminal according to another embodiment of the invention.

DETAILED DESCRIPTION OF THE PREFERRED EMBODIMENT

In FIGS. 1 and 2, one sees a terminal 5 designed to be fitted in a housing 2 provided in the rear part of a circuit breaker 3 to perform connection of an electrical cable 6 to the contact strip 4 of the circuit breaker. The terminal 5 is mainly formed by a metal block of appreciably parallelepipedic shape comprising an elongate passage **5*b* designed to receive the above-mentioned contact strip 4, and comprises at its upper part a tapped orifice into which a screw 7 called the terminal screw is screwed. The terminal screw 7 clamps the cable 6 onto the contact strip 4. The terminal screw 7 is accessible from the upper part of the apparatus and comprises at its end, situated inside the terminal 5, a screw pad 8 comprising claws 8*a* designed to operate in conjunction with complementary recesses 4*a* provided in the contact strip 4**.

According to the invention, the terminal 5 is equipped with a connector accessory 9 designed to be used for performing connection of an aluminum cable to the contact strip.

As is more particularly illustrated in FIGS. 3 and 4, this accessory 9 comprises an accessory pad 10 mounted on a support, or flexible blade 11, the assembly being designed to be fixed flexibly to the circuit breaker contact strip 4. The accessory pad 10 presents an appreciably U-shaped cross section and comprises, on its face 14, which receives the cable 6, a set of serrations 12 extending perpendicularly to the direction of the cable 6 when it is inserted in the terminal.

As previously mentioned, the support is formed by a flexible blade 11. The blade has a proximal-end **11*h*, a mid-section 11*b*, and a distal-end 11*a*. The proximal-end 11*h* is attached to the accessory pad 10, typically by a rivet 20. Additionally, the blade has a first fold 11*i* and a second fold 11*j*. The first fold 11*i* is located proximal to the second fold. These folds define the boundaries of the mid-section 11*b*; the mid-section being the region between them. The first fold 11*i* directs the mid-section 11*b* to generally point down from and run perpendicular to the accessory pad 10. The second fold 11*j* directs the distal-end 11*a* to rest below and run parallel to the accessory pad 10. Through these series of folds the flexible blade 11 is curved 180 degrees. The contact strip 4 may now be flexibly clamped between the accessory pad's underside and the blade's unattached distal-end 11*a***.

It can also be seen in these figures that the flat distal portion of the flexible blade **11*a* comprises three tabs or lugs 11*c*, 11*d*, 11*e* molded in the same material as the flexible blade and extending according to an inclined direction with respect to the plane of the curved part forming an angle of about 30° with this plane. These tabs are designed to press via their ends on the bottom wall 5*c* of a recess 5*a* provided in the terminal 5** to house these lugs.

It can also be noted that the flat distal portion of the flexible blade **11*a* comprises a boss 11*f*, on its surface facing the accessory pad 10, designed to enable the connector assembly 9 to be fitted either onto a 2.5 mm contact strip or onto a 1.6 mm contact strip. The boss 11*f* may be molded of the same material as the flexible blade 11, and created by stamping or imprinting the blade's distal-end 11*a***.

Advantageously, the screw 7 and the screw pad 8 are made of steel, whereas the block 5 is made of aluminum. The flexible blade 11 is made of stainless spring steel and attached with a rivet 20 to the accessory pad. 10, which is advantageously made of tinned copper.

According to the embodiment illustrated in FIG. 5, the circuit breaker terminal comprises a tunnel 13 mounted movable in translation in the terminal housing 2 of the apparatus between a disconnection position and a position wherein the tunnel 13 clamps the cable 6 onto the contact strip (not represented).

The connection operation of an aluminum cable onto the contact strip will be described hereafter with reference first to FIGS. 1 and 2, and then to FIG. 5.

According to the embodiment illustrated in FIGS. 1 and 2, the block 5 is first inserted into the rear part of the circuit breaker 3 by sliding said block 5 into the corresponding housing 2. Then the connector accessory 9 is fitted onto the contact strip 4 in such a way that the contact strip 4 is held flexibly between the accessory pad 10 and the flat, distal portion of the flexible blade **11*a*. The conductor 6 is then inserted in the passage 5*b* of the block and placed on the accessory pad 10. Tightening the terminal screw 7 has the effect of applying the screw pad 8 with claws 8*a* onto the cable 6 and of performing clamping of the conductor 6 onto the contact strip 4. In this clamping position, the U-shape of the accessory pad 10 enables the cable strands to be contained between the clawed screw pad 8 and the accessory pad 10** in order to prevent buckling thereof.

Furthermore, the flexible lugs or tabs **11*c*, 11*d*, 11*e* maintain a constant pressure on the screw thread thereby preventing the tunnel screw from coming loose due to the effect of the expansion differences of the aluminum cable and of the steel tunnel screw 7**. Moreover, they reduce the risk of the screw coming loose due to the effect of vibrations.

The connection operation by means of a device according to FIG. 5 is carried out for the most part in the same way as previously described for the first embodiment. However, here it is the tunnel 13, not the screw which moves in translation. The tunnel 13 clamps the cable, the cable being fitted between the accessory pad 10 and the tunnel 13.

This accessory enables standard terminals to be used (at present designed for copper cables) for connection of the aluminum cables while preserving a satisfactory electrical contact quality.

What is claimed is:

1. An accessory for connection of an electrical conductor or cable to a contact strip of an electrical apparatus comprising:

an accessory pad secured to a contact strip by a flexible blade, wherein the accessory pad comprises a conducting material, the accessory pad being removably fixable onto the contact strip for receiving a conductor to be clamped against the accessory pad by a clamping means to establish electrical contact between the contact strip and a cable;

the flexible blade comprises a proximal-end, a mid-section, and a distal-end, the proximal-end attached to the accessory pad, the blade having first and second folds, wherein the first fold and the second fold define a mid-section, the first fold is located proximal to the second fold and the mid-section extends perpendicularly from the accessory pad, the flexible blade curving 180 degrees, enabling flexible clamping of the contact strip between the accessory pad and the distal-end of the flexible blade, and further comprising at least one lug extending from the plane of the distal-end portion of the flexible blade in an inclined direction with respect to the plane and in a direction away from the pad for easing insertion of the flexible blade into a tunnel of an electrical terminal when the distal-end of the flexible blade enters first, said at least one lug for pressing against a wall of a tunnel of an electrical terminal.

2. The accessory according to claim 1, wherein the pad and support comprise a substantially shaped transverse cross section.

3. The accessory according to claim 1, wherein the accessory pad comprises, on its face facing the conductor, serrations extending perpendicularly to the longitudinal direction of the conductor.

4. The accessory according to claim 1, wherein the at least one lug is formed into the material of the blade.

5. The accessory according to claim 1, wherein the support comprises three lugs arranged in a triangle.

6. The accessory according to claim 1, wherein the cistal end comprises a boss, on its face facing the pad, designed to enable the pad to be fitted onto contact strips of different thicknesses.

7. A terminal comprising a tunnel equipped with an accessory according to claim 1.

8. The terminal according to claim 7, comprising a fixed tunnel, said tunnel comprising an orifice for insertion of a clamping screw for securing a conductor.

9. The terminal according to claim 8, comprising a tunnel movable between a position clamping a conductor onto the contact strip and a disconnection position.

10. A terminal comprising a tunnel, wherein the tunnel comprises a recess in its bottom wall designed to receive the lug(s) of an accessory according to claim 1.

11. The accessory according to claim 6, wherein the boss is a formed portion of the blade.

* * * * *